United States Patent [19]

Sexton et al.

[11] 4,087,286

[45] May 2, 1978

[54] SWIMMING POOL CLEANING DEVICE

[75] Inventors: Wilson B. Sexton, Dallas; Frankie N. Spencer, McKinney, both of Tex.

[73] Assignee: Airwick Pool Products, Inc., Richardson, Tex.

[21] Appl. No.: 762,305

[22] Filed: Jan. 25, 1977

[51] Int. Cl.[2] ..... B08B 3/02; B08B 9/08

[52] U.S. Cl. ..... 134/167 R; 210/169; 239/229

[58] Field of Search ..... 134/167 R, 168 R; 15/1.7; 239/229, 562; 4/172.15, 172.16; 210/169

[56] References Cited

U.S. PATENT DOCUMENTS

| | | | |
|---|---|---|---|
| 3,170,180 | 2/1965 | Winston et al. | 134/167 R X |
| 3,315,692 | 4/1967 | Arneson | 134/167 R |
| 3,665,942 | 5/1972 | Moore | 15/1.7 X |
| 3,718,148 | 2/1973 | Gibellina | 134/167 R |
| 3,883,366 | 5/1975 | Blumenfeld | 134/167 R X |
| 4,023,581 | 5/1977 | Pansini | 134/167 R |

*Primary Examiner*—Robert L. Bleutge

*Attorney, Agent, or Firm*—Curtis, Morris & Safford

[57] ABSTRACT

A swimming pool cleaning apparatus is disclosed which includes a drive head that is continuously biased towards the side wall of the swimming pool by a pair of water jets located on a manifold rotatably mounted on a buoyant portion of the head. The jets are arranged to produce a resultant propulsion force extending through the mounting axis of the manifold on the buoyant head, in order to propel the head towards and along the wall of the pool. When the head engages an obstacle or side wall its forward movement is stopped and the force acting on the manifold causes the manifold to rotate and redirect the resultant force, thereby changing the direction of movement of the head so that it can pass around the obstacle or turn at a corner of the pool.

17 Claims, 8 Drawing Figures

FIG. 1
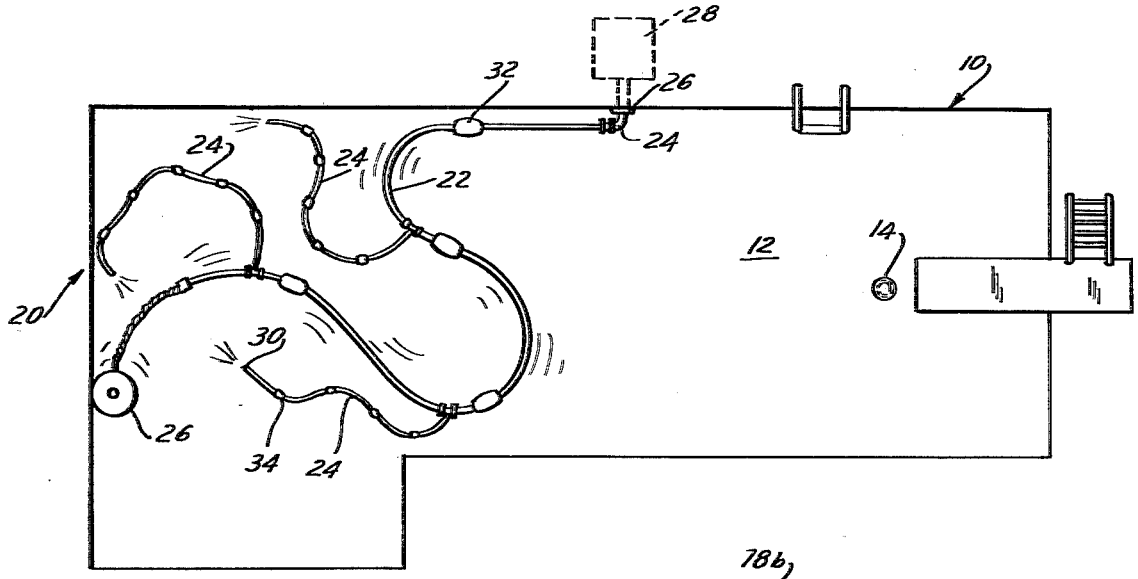
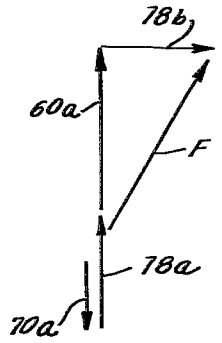
FIG. 8
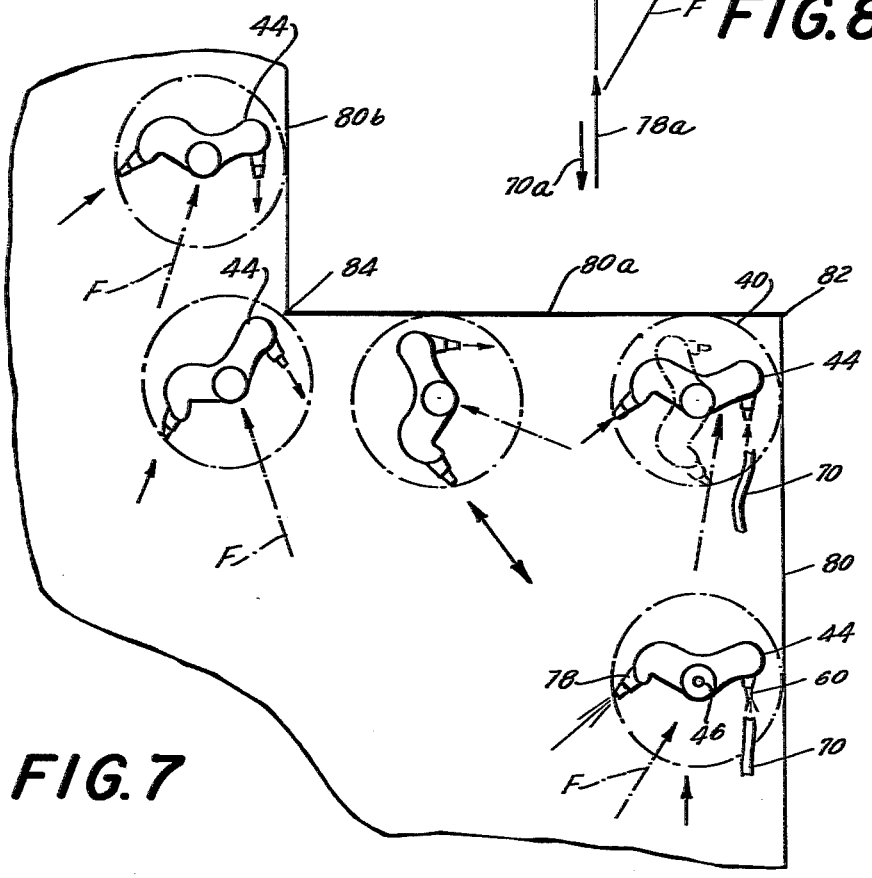
FIG. 7

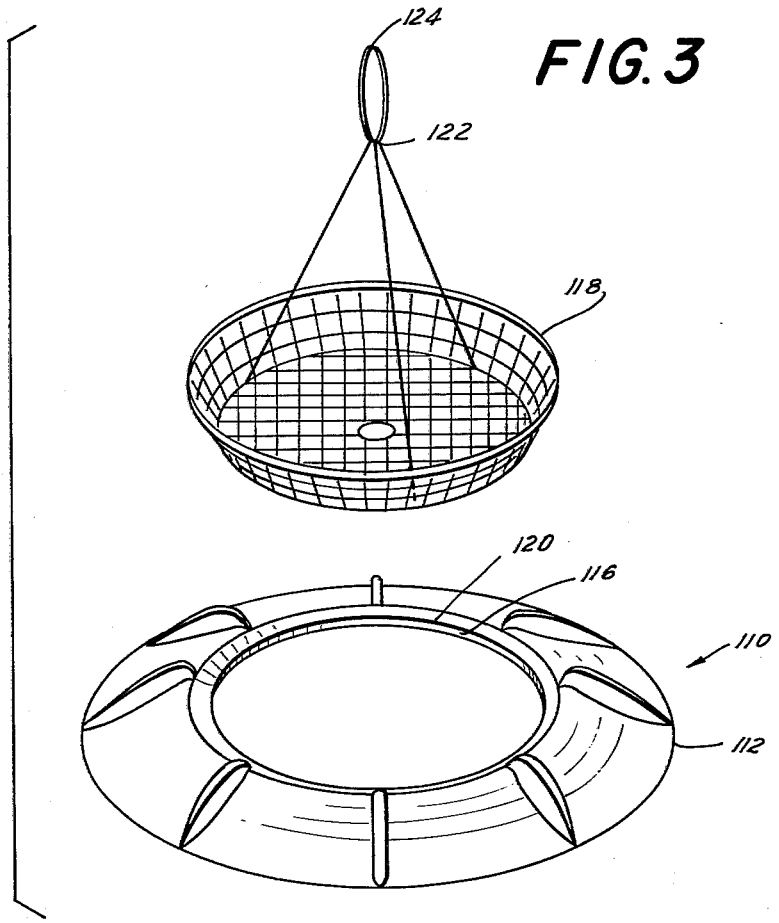
FIG. 3
FIG. 5
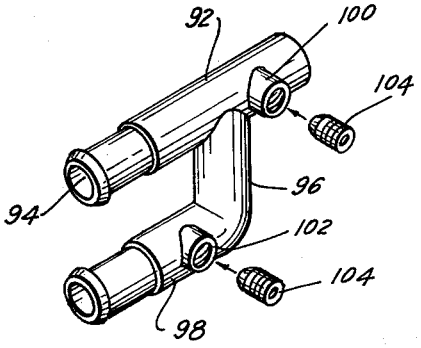
FIG. 6
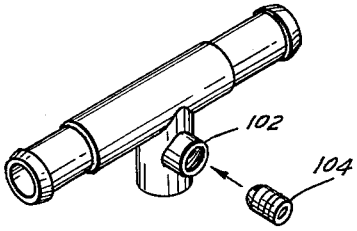

SWIMMING POOL CLEANING DEVICE

The present invention relates to swimming pool cleaning devices, and more particularly to a swimming pool cleaning device of the type having a jet powered head adapted to continuously engage and be driven along the side wall of the pool while dragging behind it a series of whipping hoses used to clean the side walls and bottom of the pool.

With the burgeoning growth of the swimming pool industry a commensurate rise in the demand for and development of devices for cleaning swimming pools has occurred. Some of the earliest devices, such as for example shown in U.S. Pat. Nos. 3,032,044 to Pansini and 2,919,027 to Blumenfeld disclosed the concept of using whipping hoses through which water is discharged under pressure so that the hoses will move sinuously along the bottom and sides of the pool in order to disturb silt and other materials clinging to the bottom and side walls thereby to place such materials in suspension and to drive them towards the bottom drain of the pool. By the use of such equipment the need to vacuum the pool is avoided or substantially reduced, thus saving the pool owner a procedure which is either time consuming if he does it himself or relatively expensive if done by a pool cleaning service.

These early patents disclose mechanical and water jet systems for propelling the whipping hoses around the pool. However, because of the primitive nature of the devices they were not entirely satisfactory for use and therefore far more sophisticated devices were developed. For example, as shown in U.S. Pat. No. 3,291,145 a water powered turbine drive system is used for propelling a floating head in a swimming pool cleaning device along a programmed and relatively constant path of travel, with the head moving along the side wall of the pool during a major portion of its motion. This head drags with it whipping hoses for cleaning the side wall and bottom of the pool. Such devices have been found to be highly satisfactory in use, however the multiple moving parts used in the apparatus require attention from time to time, and make the apparatus relatively expensive to manufacture and purchase.

Still other types of swimming pool cleaning apparatus, of more complexity than the originally developed pool cleaners of this type are shown for example in U.S. Pat. No. 3,170,180; 3,265,079; 2,975,791; 3,139,099; 3,289,216; and 3,295,540. Such devices use multiple swinging arms and valve controlled water jets, in order to guide the floating head of the apparatus in a predetermined path, usually along the side wall of the pool. However, each of those devices is relatively complex, requiring multiple moving parts which would require a substantial amount of maintenance.

Another improved pool cleaning apparatus is disclosed in U.S. Pat. No. 3,926,667 to Michael C. Gibellina. That patent discloses a pool cleaner which attempts to overcome the problems of the prior art and provide a cleaning device having a minimum number of moving parts. The apparatus includes a cleaning or drive head on which a water manifold is rotatably mounted. The manifold carries a pair of essentially parallely arranged water jets for propelling the cleaning head in the desired direction of movement around the pool. In addition, that apparatus includes a third power jet which controls the cleaning head and aids it in moving about obstacles in the pool or making turns at the corners of the pool. However, it is often difficult to properly align the third power jet with respect to the other jets in this apparatus in order to obtain proper guiding movement for the head. This is particularly true because of the flexible connections provided between the third power jet and the manifold.

Accordingly, it is an object of the present invention to provide a pool cleaning apparatus having a minimum number of parts, with a relatively simple drive control mechanism for guiding and driving the pool cleaning head around the periphery of the pool.

Another object of the present invention is to provide a pool cleaning apparatus which can agitate the water adjacent the entire submerged surface of the pool in order to clean those surfaces.

Another object of the present invention is to provide a pool cleaning apparatus for cleaning the submerged side walls and bottom walls of the pool.

A still further object of the present invention is to provide a water drive for the head of a pool cleaning apparatus which will drive the head along the side wall of the pool in a forward direction while allowing the head to make turns at the corners of the pool in either direction.

A still further object of the present invention is to provide a pool cleaning apparatus in which the water flow to the whipping hoses of the apparatus can be controlled.

Yet another object of the present invention is to provide a swimming pool cleaning apparatus which is inexpensive to manufacture and durable in use.

Another object of the present invention is to provide a swimming pool cleaning apparatus which is relatively easy for the homeowner to operate.

In accordance with an aspect of the present invention a swimming pool cleaning apparatus for cleaning the bottom and side walls of a swimming pool is provided in which a bouyant cleaning head is movable about the surface of water within the pool for moving a water supply hose and a plurality of whipping hoses connected thereto about the pool so that the whipping hoses will extend to all areas of the submerged surface of the pool to clean the pool surfaces, place dirt in suspension and direct the dirt on the surfaces of the pool towards the pool drain. The cleaning head includes a bouyant float and a hollow water manifold rotatably mounted on and below the float for rotation about a generally vertical axis with respect to the float. The water supply hose is operatively connected at one end to the manifold and is adapted to be connected at its opposite end to a source of water under pressure. The supply hose includes a flexible hose section connected to the manifold in offset lateral relation to said axis, to permit relative movement between the manifold and the remainder of the hose.

The manifold includes a first water jet opening therein located in parallel axial alignment with the flexible hose section and a second water jet opening located in laterally spaced relation to the first water jet opening, with the axis of rotation of the manifold being positioned between the two jets. The second water jet opening is located at an acute angle to the first water jet opening in a predetermined position selected such that when water under pressure is supplied through the supply hose to the manifold, the drag of the supply hose on the manifold and the first and second water jets produce a resultant force which passes generally perpendicularly through the axis of rotation of the manifold at an acute angle to the axis of the flexible hose section, thereby to propel the head in the direction opposite, and at an angle, to the direction of water discharged from the first jet whereby the head will engage a side wall of the pool and move therealong. When the head hits an obstacle or wall of the pool, blocking forward movement of the head, drag on the head from the supply hose is reduced, causing the resultant force to shift closer to the first jet away from the axis of rotation of the manifold whereby the resultant force applied to the head is effectively changed and repositioned with the result that the manifold rotates and the head is driven in another direction.

The above, and other objects, features and advantages of this invention will be apparent in the following detailed description of an illustrative embodiment thereof, which is to be read in connection with the accompanying drawings, wherein:

FIG. 1 is a plan view of a swimming pool having a swimming pool cleaning apparatus according to the present invention positioned therein;

FIG. 3 is an exploded perspective view of a leaf basket adapted to be used in conjunction with the swimming pool cleaning apparatus of the invention;

FIG. 5 is a perspective view of a connecting element for connecting a whipping hose to the water supply hose of the apparatus;

FIG. 6 is a perspective view of another form of connecting element;

FIG. 7 is a diagrammatic illustration of the operation of the apparatus as it makes left and righthand turns about corners of the pool; and FIG. 8 is a schematic force diagram of the forces operating on the manifold of the drive head for driving the head in the desired relation to the side walls of the pool.

Figure 2:
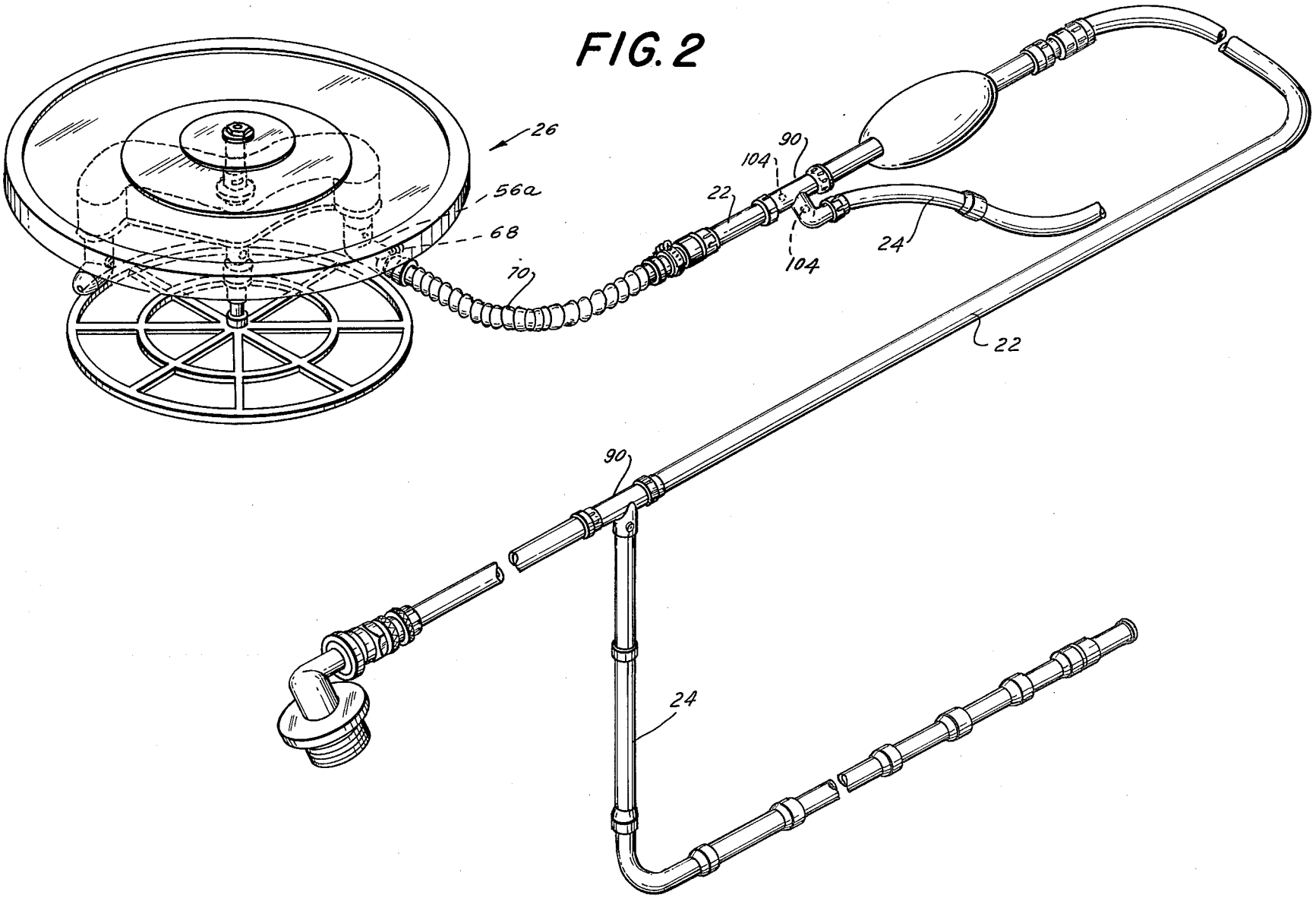
FIG. 2 is an enlarged perspective view of the swimming pool cleaning apparatus according to the present invention.

Referring now to the drawing in detal, and initially to FIG. 1 thereof, a swimming pool 10 is illustrated which is filled with water and has a plurality of side walls and a bottom wall 12, in which a bottom drain 14 is provided. In the usual manner, drain 14 is located at the deepest end of the swimming pool for removing water from the pool and supplying it to the pool filtering system from which the water is returned through inlets (not shown) to the pool. In a typical swimming pool of this type, the bottom wall 12 slopes from a shallow end portion at the left in FIG. 1 to the deeper end portion and main drain 14, and has a plurality of steps 16 located in an offset with respect to the remainder of the pool.

A swimming pool cleaning apparatus 20, constructed in accordance with the present invention, is illustrated as being positioned in the pool during operation. The apparatus includes a water supply hose 22 to which a plurality of whipping hoses 24 are connected, and a drive head 26 which serves to move the supply and whipping hoses about the pool. In accordance with the invention drive head 26 is constructed to follow the side wall of the pool and, in the illustrative embodiment, it moves in a generally counterclockwise direction. Although the device is illustrated with the generally L-shaped pool of FIG. 1, it can of course be used with pools of any shape, and it can be controlled to move in a clockwise direction as opposed to a counterclockwise direction as opposed to a counterclockwise direction if desired.

The water supply hose 22 has an inner end 24 which is connected to a source of water under pressure through a water inlet 27. In the illustrative embodiment of the invention the inlet 27 is connected to the water return line of the filter system for the pool in the usual manner for swimming pool cleaners, and a booster pump 28 may be provided to increase the pressure of water returned to the pool through the pool cleaning apparatus of the present invention if desired or necessary. The whipping hoses 24 are suspended along the length of the supply hose 22 and receive water from the supply hose for discharge through the free ends 30 thereof. These ends may be simply openings at the ends of the hose, or may be provided with nozzles in the typical manner for such whipping hoses. The whipping hoses operate in the known fashion, by oscillating or snaking about in the pool water to agitate dirt or slit on the submerged pool surfaces and direct it towards the deep end of the pool and main drain 14.

Although the illustrative embodiment of the invention illustrates the supply hose 22 as being connected to a wall inlet 27 in the side wall of the pool, it is contemplated that the hose may also be connected to a separate deck stand from which water under pressure is supplied. Such deck stands are known in the art and would be used when the pool cleaning apparatus of the present invention is purchased after the pool is built.

Preferably, supply hose 22 is formed of a bouyant plastic material so that it floats on the surface of the pool and does not interfere with the operation of the whipping hoses or the drive head. To aid in flotation of the supply hose however, individual float members 32 formed of polyurethane, or another convenient bouyant material, can be mounted along the hose to aid in keeping the hose on the surface of the water. The whipping hoses 24 are formed of the same material, but are however, provided with weight elements 34 along their length, in order to keep the whipping hoses submerged during operation.

Figure 4:
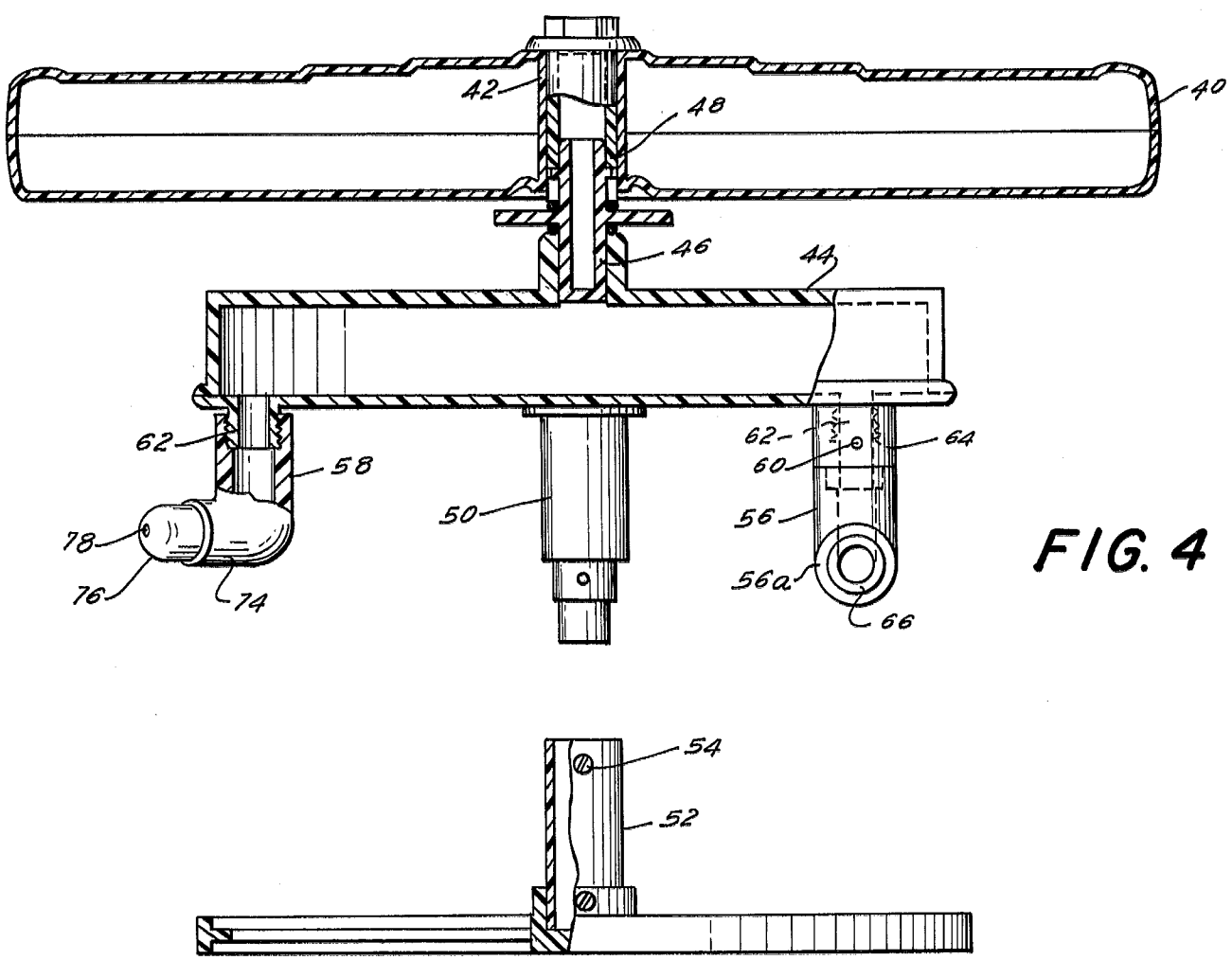
FIG. 4 is an enlarged sectional view of the bouyant drive head used in conjunction with the apparatus of the present invention.

Drive head 26, illustrated in greater detail in FIGS. 2 and 4, includes a bouyant float member 40 formed as a molded hollow disk having a central opening 42 formed therein. A hollow manifold 44 is rotatably mounted on float 40 so that it is suspended from the float when the float is placed on the surface of water in the pool. The manifold includes an integral stem 45 rigidly secured thereto and extending upwardly therefrom. This stem is rotatably received in a bearing 48 mounted within central opening 42 of float 40 so that the manifold can rotate with respect to the float, and the float can rotate freely with respect to the manifold.

Manifold 46 also includes a lower stem 50 on which a guide disk 52 is fixed, as for example by a lock screw 54 or the like. Disk 52 has a diameter which is approximately equal to the diameter of float 40 and is provided to engage underwater obstacles and steps, along the side wall of the pool, to prevent the drive head from becoming jammed, for example, against the topmost step of the pool.

A pair of hollow elbows 56, 58 are threadedly mounted on manifold 44. Preferably elbow 56 is locked in position on the manifold so that its lower leg **56*a* extends generally perpendicularly to the principle axis of the manifold. This elbow has a hole or port 60 formed therein (as for example by drilling) extending into the passageway 62 defined in the threaded portion of collar 64 of the manifold on which the elbow is mounted. In this manner water supplied to the manifold will be discharged through port 60**, as described hereinafter.

The free end 66 of elbow 56 is connected in any convenient manner, as for example by a collar type clamp 68, to a flexible hose section 70 of supply hose 22. The flexible hose section is preferably formed as an accordian type hose which permits free flexing movement of the hose section. The flexibility of this hose permits the floating drive head to move laterally with respect to the hose and essentially isolates the drive head from the remainder of the hose, except when the head is moving in a forward direction to drag the supply hose 22 therewith. Port 60 is located in elbow 56 to extend axially parallel to the lower leg 56*a* of the elbow 56, whereby the jet of water discharged from the port 60 is projected axially parallel to the longitudinal axis of flexible hose section 70.

Elbow 58 is also threadedly mounted on another collar or neck 64 of the manifold 44. However, this elbow is located on the opposite side of the axis of rotation of the manifold, defined by stem 46, from elbow 56. This elbow has a lower leg 74 in which a nozzle 76 is formed having a water discharge port 78. In operation elbow 58 is positioned such that the nozzle 76, and thus discharge port 78, is positioned at an acute angle with respect to elbow 56 and the direction of water projected from port 60. This angle preferably is on the order of 45°, but it is adjustable in order to locate the resultant force produced by jets 60, 78 so that the resultant force will pass through the axis of rotation of manifold 44 during normal operation of the device, with the result that the drive head will be biased towards the wall of the pool and will move forwardly along that wall.

Thus, as seen in FIGS. 7 and 8, when the drive head is placed in the pool, and water is supplied to the head through supply hose 22, water is discharged from jet openings 60, 78 and a resultant force F is produced. This force extends at an acute angle to the jet 60 so that it will drive the head towards the side wall 80 of the pool. If the drive head is dropped in the middle of the pool, remote from the side wall, force F will move the head in the direction of the resultant force F until the head hits one of the side walls 80 of the pool. When the head engages the pool, it cannot move further to the right, as illustrated in FIG. 7, but will be biased by the force F against the side wall 80 and move forwardly in the direction A, opposite to the direction of discharge of the water from nozzle 60. This forward movement of the head along the side wall 80 drags supply hose 22 and thus the flexible hose section 70 therewith and produces a slight drag on manifold 44.

Accordingly, as the drive head moves along side wall 80, at least four different force components act on manifold 44, as illustrated in FIG. 8. The force produced by water jet 60, which serves to propel the head forwardly, also produces a moment force on manifold 44 which tends to rotate the manifold in a counterclockwise direction about axis 46. Water jet 78 produces two forces to the manifold, namely a component of force 78*a* which tends to rotate the manifold in a clockwise direction, and a component of force 78*b* which tends to rotate the manifold in a counterclockwise direction. In addition, the drag produced by flexible hose 70 produces a force 70*a* which counters the force of water jet 60 and tends to rotate manifold 44 in a clockwise direction. As a result of these four forces, resultant force F is produced which, by properly adjusting the angle of jet 78, passes through the axis of rotation 46 of the manifold so that during normal operation the manifold does not rotate, but rather the entire head moves in a stable configuration along the side wall of the pool. Because of the engagement of float 40 with the side wall of the pool, the float may rotate along the pool wall but the manifold remains in a relatively fixed position as it moves forwardly along the side wall of the pool.

When drive head 26 encounters a corner, such as for example the corner 82 illustrated in FIG. 7, float 40 engages wall 80*a*, so that continued forward movement of the drive head is blocked. When this occurs, the supply hose and flexible section 70 continue to move forwardly due to the momentum which they contain, but that forward movement is not imparted to manifold 44 because flexible hose 70 will merely buckle under that momentum. This action of hose 70 removes the drag on manifold 44, with the result that the magnitude and location of resultant force F applied to the manifold is changed. Thus force components 60*a* and 78*b* will rotate the manifold in a counterclockwise direction about its axis of rotation 46. This rotation of the manifold causes resultant force F to rotate until manifold 44 has rotated to a sufficient extent such that resultant force F drives the manifold along wall 80*a*. As the head begins to move, float 40 rotates and manifold 44 will assume its stabilized position and move, in the manner previously described, along the side wall of the pool.

When pool cleaning head 26 approaches a right hand turn corner, such as for example the corner 84 illustrated in FIG. 7, the right hand bias of resultant force F on the manifold 44 will drive the manifold to the right, in an attempt to keep float 40 against the side wall of the pool. Because the rightward movement of the cleaning head will be unrestrained, the force produced by jet 78 will cause the manifold to rotate in a clockwise direction as the resultant force moves the entire manifold and drive head assembly forward, with the result that the direction of drive of the resultant force is varied until the main drive head is against the side wall 80*b* of the pool wherein float 40 engages the side wall and the manifold is stabilized to move along the side of the pool.

In accordance with another feature of the invention the flow of water through manifold 44, as well as to the whipping hoses 24, can be controlled in order to balance the forces acting on the manifold and to control the speed of oscillation or snaking of the whipping hoses.

For this purpose, supply hose 22 is provided with connector elements 90 at the points to which the whipping hoses 24 are to be connected to the supply hose. These connecting elements or members are essentially molded plastic T's which are secured to the hose 22, in line therewith, by mend installations in a conventional manner. The molded plastic T closest to drive head 26 is illustrated in FIG. 5. This T includes a cross piece 92 having through bore 94 through which water in supply hose 22 passes. Stem 96 of this T includes an angle or elbow 98 which is connected by a mend nut or the like to its associated whipping hose 24. The connecting member has threaded bores 100, 102 formed therein which receive threaded screws 104 respectively. By rotating the screws in their associated threaded bores, the screws will be projected into the through passages in stem 92 and elbow 98, thereby to restrict the passages and control the flow of water therethrough. In this manner, screw 104 in the bore 100 can be adjusted to control the rate of water flow to manifold 44 while the screw 104 in bore 102 controls the rate of water flow to wall whipping hoses 24.

The connection members 90 associated with the other whipping hoses are simply T connections, as seen in FIG. 6, each having a threaded bore 102 threrein receiving a screw 104 to permit the user to adjust the volume of flow passing through the respective whipping hoses 24. In this manner, the operator can control the speed of movement or oscillation of the whipping hoses, to insure optimum cleaning effects.

The filtering apparatus of the present invention is preferably used with a leaf trap 110 illustrated in FIG. 3 of the drawing. This trap is placed over main drain 14 and includes an annular collar 112 which rests on the bottom of the pool and has a central opening 116 which is aligned with the drain 14. A foraminous basket 118 is adapted to be seated on lip 120 of collar 112 and has a plurality of pickup support arms 122 terminating in a loop 124. In operation of the pool cleaning device, the silt or dirt on the bottom and side walls of the pool is directed by the whipping hoses towards the deep end of the pool. The silt and dirt is directed by the tapered sides of annular ring 112 upwardly into basket 118, and then it is drawn through the basket into the main drain. By this arrangement, any large debris, such as leaves or paper, will be trapped in basket 118 and will not clog the main drain. The basket 118 is readily removed from the ring 112 by simply placing one end of a pool cleaning brush mounted on a long handle in loop 124 and lifting the basket out of the pool. The basket is readily placed back in ring 112 in the same manner.

Accordingly, it is seen that a relatively simply constructed pool cleaning apparatus is provided in which, with a minimum of parts, the drive head for the apparatus is held against the side of the pool and made to follow the pool wall, thereby to move the whipping hoses associated therewith along the entire surface of the pool. The relatively simple drive arrangement prevents the drive head from becoming entrapped in any of the corners of the pool, and uses a minimum number of parts which would require repair or replacement.

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of this invention.

What is claimed is:

1. A swimming pool cleaning apparatus for washing the bottom and side walls of a swimming pool, said apparatus including a bouyant cleaning head movable about the surface of water within the pool, said head comprising a bouyant float and a hollow water manifold rotatably mounted on and below said float for rotation about a generally vertical axis with respect to the float; a water supply hose operatively connected at one end to said manifold and being adapted at its opposite end to be connected to a source of water under pressure; said supply hose including a flexible hose section connected to said manifold, in offset lateral relation to said axis, to permit relative movement between the manifold and the remainder of the hose; said manifold including a first water jet opening therein located in parallel axial alignment with said flexible hose section and a second water jet opening located in laterally spaced relation to the first jet opening with said axis being positioned therebetween; said second water jet opening being located at an acute angle to the first water jet opening in a predetermined position selected such that when water under pressure is supplied through said supply hose to said manifold said first and second water jets produce a resultant force which passes generally perpendicularly through said axis at an acute angle to the axis of said flexible hose section thereby to propel said head in a direction opposite and at an angle to the direction of water discharged from said first jet whereby said head will engage a side wall of the pool and move therealong and, when said float hits an obstacle or wall of the pool blocking forward movement of the head, drag on the head from the hose is reduced causing said resultant force to shift closer to said first jet away from said axis to rotate said manifold and reposition the resultant force to drive the head in another direction.

2. A swimming pool cleaning apparatus as defined in claim 1 wherein said manifold includes a pair of laterally spaced hollow elbows mounted thereon with said axis therebetween, one of said elbows having an open end connected to said flexible hose section and a port formed therein above the connection to the flexible hose section to define said first jet; the other of said elbows having a closed free end including a port formed therein defining said second jet, said elbows being mounted on said manifold at an angle to each other.

3. A swimming pool cleaning apparatus as defined in claim 2 including at least one whipping hose connected in fluid communication to said hose and extending therefrom to a free end for producing a randomly moving spray flow of water against the submerged side walls and bottom of the pool.

4. A swimming pool cleaning apparatus as defined in claim 3 including means for connecting said whipping hose to said hose including means for adjusting water flow to at least one of said whipping hose and manifold.

5. A swimming pool cleaning apparatus as defined in claim 4 wherein said adjusting means includes means for separately adjusting water flow to both said whipping hose and manifold.

6. A swimming pool cleaning apparatus as defined in claim 5 wherein said adjusting means comprises a pair of screws threadedly mounted in said connecting means in association with said whipping hose and manifold whereby the screws can be adjusted to selectively restrict water flow to the manifold and whipping hose respectively.

7. A swimming pool cleaning apparatus as defined in claim 6 including a plurality of whipping hoses connected to said hose and means associated with each of said whipping hoses for adjusting water flow therethrough.

8. A swimming pool cleaning apparatus as defined in claim 2 wherein said other elbow is mounted on said manifold for angular adjustment to permit the angle between said water jets to be varied.

9. A swimming pool cleaning apparatus as defined in claim 8 wherein the angle between said water jets is on the order of 45°.

10. A swimming pool cleaning apparatus as defined in claim 1 including at least one whipping hose connected in fluid communication to said hose and extending therefrom to a free end for producing a randomly moving spray flow of water against the submerged side walls and bottom of the pool.

11. A swimming pool cleaning apparatus as defined in claim 10 including means for connecting said whipping hose to said hose including means for adjusting water flow to at least one of said whipping hose and manifold.

12. A swimming pool cleaning apparatus as defined in claim 11 wherein said adjusting means includes means for separately adjusting water flow to both said whipping hose and manifold.

13. A swimming pool cleaning apparatus as defined in claim 12 wherein said adjusting means comprises a pair of screws threadedly mounted in said connecting means in association with said whipping hose and manifold whereby the screws can be adjusted to selectively restrict water flow to the manifold and whipping hose respectively.

14. A swimming pool cleaning apparatus as defined in claim 13 including a plurality of whipping hoses connected to said hose and means associated with each of said whipping hoses for adjusting water flow therethrough.

15. In a swimming pool cleaning apparatus including a water supply hose, a plurality of whipping hoses connected to the supply hose and a buoyant head including a water manifold having water jet openings therein for moving the whipping hoses about the pool, the improvement comprising separate means for connecting each whipping hose to the water supply hose; each of said connecting means including means for controlling water flow to its associated whipping hose; and separate means for controlling water flow to said manifold.

16. In a swimming pool cleaning apparatus as defined in claim 15 wherein the connecting means nearest the head along said supply hose includes said separate means for controlling water flow to said head.

17. In a swimming pool cleaning apparatus as defined in claim 16 wherein said controlling means each comprise a threaded screw mounted in their associated connecting means and extending into the path of water flow therein whereby the screws can be adjusted to selectively restrict water flow to the head and whipping hoses respectively.

* * * * *